US008291610B2

(12) United States Patent
Bergaglio

(10) Patent No.: US 8,291,610 B2
(45) Date of Patent: Oct. 23, 2012

(54) APPARATUS FOR DRYING A PAINTING PRODUCT AND OPERATING METHOD THEREOF

(75) Inventor: Osvaldo Bergaglio, Sasso Marconi (IT)

(73) Assignee: Symach S.R.L., Crespellano (IT)

( * ) Notice: Subject to any disclaimer, the term of this patent is extended or adjusted under 35 U.S.C. 154(b) by 350 days.

(21) Appl. No.: 12/579,575

(22) Filed: Oct. 15, 2009

(65) Prior Publication Data

US 2010/0088921 A1 Apr. 15, 2010

(30) Foreign Application Priority Data

Oct. 15, 2008 (EP) ..... 08425667

(51) Int. Cl.
*F26B 3/34* (2006.01)

(52) U.S. Cl. ..... 34/270; 34/269

(58) Field of Classification Search ..... 34/266, 34/268, 269, 270, 666; 431/328; 126/92 AC, 126/92 B See application file for complete search history.

(56) References Cited

U.S. PATENT DOCUMENTS

| | | | | |
|---|---|---|---|---|
| 3,099,258 | A | 7/1963 | Kurz | |
| 3,215,495 | A * | 11/1965 | Andresen et al. | 423/376 |
| 3,922,136 | A * | 11/1975 | Koch | 431/328 |
| 5,033,203 | A * | 7/1991 | Chang et al. | 34/270 |
| 5,261,812 | A | 11/1993 | Javet et al. | |
| 2004/0123491 | A1 * | 7/2004 | Schneider | 34/666 |
| 2008/0014368 | A1 * | 1/2008 | Feyrer et al. | 34/270 |

FOREIGN PATENT DOCUMENTS

| | | | |
|---|---|---|---|
| DE | 1 187 339 | B | 2/1965 |
| DE | 298 11 072 | U1 | 8/1998 |
| EP | 0 851 193 | A2 | 7/1998 |
| EP | 1 398 587 | A2 | 3/2004 |
| FR | 2 680 867 | A1 | 3/1993 |
| JP | 59-200117 | A | 11/1984 |
| JP | 59-221508 | A | 12/1984 |
| WO | 02/084191 | A1 | 10/2002 |

OTHER PUBLICATIONS

D. Jones, et al; "Combustion catalytique et gaz naturel" Revue Generale De Thermique, Elsevier Editions Scientifiques Et Medicales, Paris, FR, vol. 28, No. 330/331, Jun. 1, 1989, pp. 401-406, XP000036693 ; ISSN: 0035-3159.
European Search Report: EP 08 42 5667.

* cited by examiner

*Primary Examiner* — Jiping Lu
(74) *Attorney, Agent, or Firm* — Ladas & Parry, LLP

(57) ABSTRACT

An apparatus for drying a paint applied onto a bodywork of a motor vehicle, which apparatus is provided with a radiating assembly equipped with at least one catalytic panel fed with hydrocarbon gas for generating a first infrared radiation emission spectrum in the short-wavelength infrared band, in virtue of a catalytic reaction between the hydrocarbon gas and the oxygen present in the air, and arranged so as to emit the infrared radiations towards the bodywork to dry the paint, and is further provided with at least one air supplying device for blowing compressed air onto the catalytic panel so as to affect the catalytic reaction and generate a second infrared radiation emission spectrum distributed on the entire short-wavelength infrared band and broader than the first emission spectrum.

9 Claims, 4 Drawing Sheets

APPARATUS FOR DRYING A PAINTING PRODUCT AND OPERATING METHOD THEREOF

The present invention relates to an apparatus for drying a painting product and to the operating method of such an apparatus.

BACKGROUND OF THE INVENTION

Specifically, the present invention is advantageously, but not exclusively, applied to an apparatus structured for being able to dry a paint or painting product in general applied onto a motor vehicle or component parts thereof to which explicit reference will be made in the following description without therefore loosing in generality.

As known, the operation of some apparatuses currently employed for drying paints applied onto the bodywork or bodywork parts of a motor vehicle, is essentially based on the principle of transmitting heat to the paint itself "by convection". Such apparatuses indeed comprise generating a high temperature air flow directed towards the motor vehicle. Such apparatuses typically comprise a drying oven or booth adapted to accommodate a motor vehicle on the bodywork of which a paint to be dried has been applied; and a hot air generating circuit which provides for heating up the air and blowing the heated air towards the motor vehicle, so as to determine the paint drying.

The aforesaid apparatuses are particularly disadvantageous because relatively long times are required for completely drying the paint with consequent, relatively high energy consumptions.

Apparatuses in which the operation is essentially based on the principle of transmitting heat to the paint "by radiation" are also known. Such apparatuses emit infrared radiation beams towards the motor vehicle. Such apparatuses typically comprise infrared (IR) lamps structured to emit infrared radiations in the so-called "short-wavelength infrared" band, and specifically infrared radiations having a wavelength in the range of about 2-3 μm, or infrared lamps structured to emit radiations in the so-called "medium-wavelength infrared" band, and specifically infrared radiations having a wavelength in the range of about 4-6 μm.

The infrared radiations generated by the "short-wavelength" IR lamps are able to transfer a percentage of radiated energy between about 8% and 12% to the paint molecules, thus activating a cross-linking process of the molecules themselves, i.e. a process which leads to the formation of strong bonds between the paint molecules, while the remaining percentage of energy is dispersed through the body of the object onto which the paint is applied. The drying process is carried out by the convective exchange between the body and the layer of paint. The completion time of the paint cross-linking process is thus variable because it depends on both the material of the body and the thickness of the applied paint layer. Therefore, in addition to being variable, the total paint drying times are also rather long due to the inevitable dispersion of heat in the body.

Instead, with regards to the apparatuses provided with "medium-wavelength" IR lamps, about 40% of the radiated energy is dispersed into the external environment and partially given back to the body by means of a rather slow convective process, while the radiated energy which reaches the layer of paint is withheld by the external surface of the body which, by conduction, transfers it therein. In this case, the type of material of the body does not affect the total drying time, which however is disadvantageously very long.

SUMMARY OF THE INVENTION

It is the object of the present invention to construct an apparatus which is free from the above-described drawbacks and which is, at the same time, easy and cost-effective to be implemented.

According to the present invention, an apparatus for drying a painting product applied to an object is made as set forth in the attached claims.

Furthermore, according to the present invention, a method of operating an apparatus for drying a painting product is provided as set forth in the attached claims.

BRIEF DESCRIPTION OF THE DRAWINGS

The present invention will now be described with reference to the accompanying drawings, which show a non-limitative embodiment thereof, in which.

DETAILED DESCRIPTION OF THE INVENTION

Figure 1:
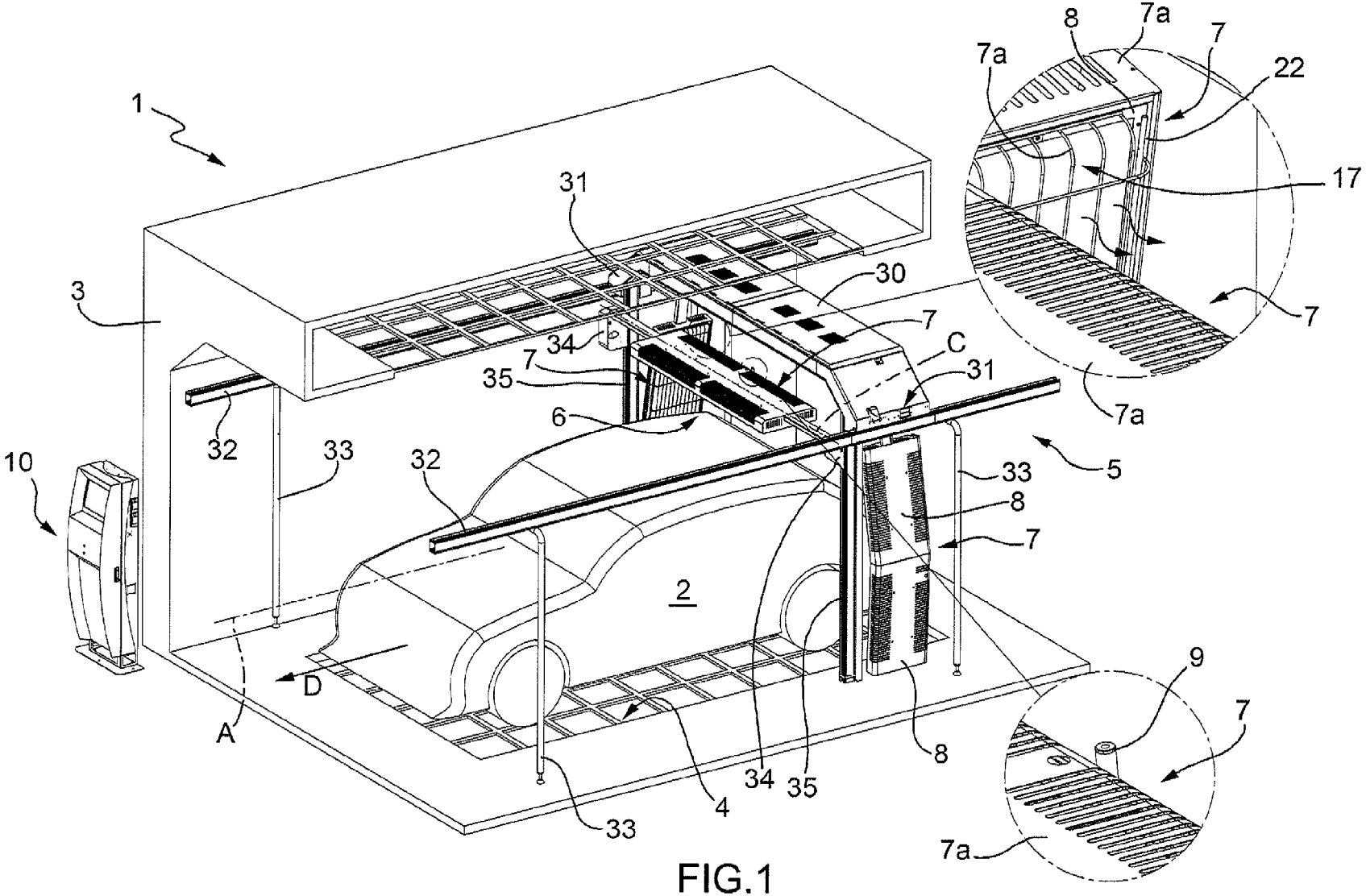
FIG. 1 shows a diagrammatic, perspective view, with parts in section, parts on enlarged scale and parts removed for clarity, of a painting product drying apparatus, which apparatus is made according to the dictates of the present invention.
Figure 2:
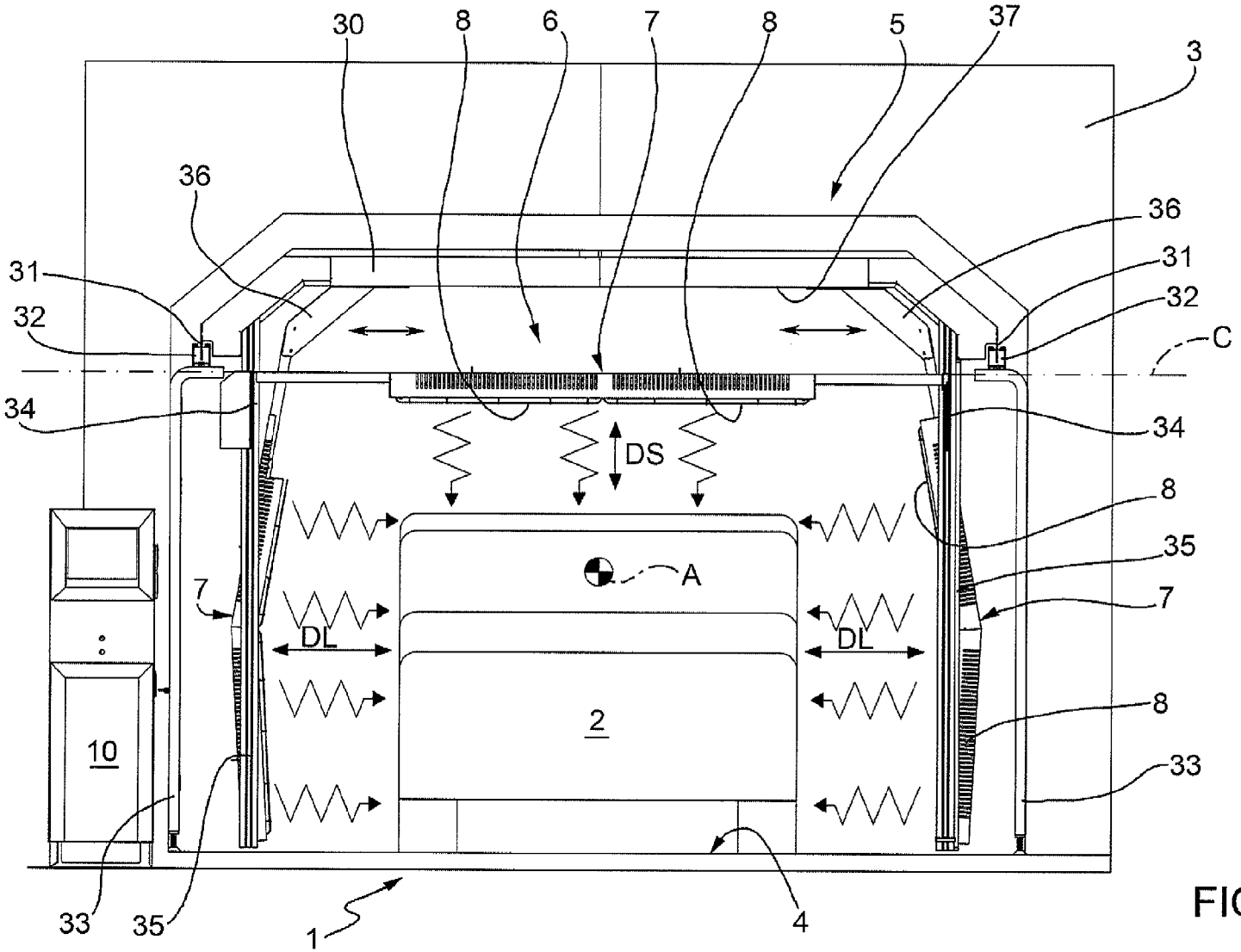
FIG. 2 shows a diagrammatic front view of the apparatus shown in FIG. 1.

In FIGS. 1 and 2, numeral 1 generally indicates, as a whole, an apparatus for drying at least one painting product previously applied onto the body of an object. Specifically, in the example shown in FIGS. 1 and 2, the apparatus 1 is structured to be able to dry a painting product applied onto the bodywork of a motor vehicle or parts of the bodywork itself, which bodywork is indicated by numeral 2.

It is worth mentioning that, in the following description, the word "paint" will mean a painting body filler, or a primer, or a clear or non-clear top coat, or a waterborne paint, or any other similar type of paint.

The apparatus 1 comprises a drying booth 3, which extends along a longitudinal axis A according to a preferably, but not necessarily, parallelepiped shape and is provided with a horizontal base 4 having a preferably, but not necessarily, rectangular shape. The motor vehicle, the bodywork 2 of which is concerned by the applied paint drying treatment, is placed over the base 4.

The apparatus 1 further comprises a gantry structure 5, which is arranged inside the drying booth 3 resting on the base 4 and is adapted to translate along a direction D substantially parallel to the longitudinal axis A, straddling the bodywork 2, and a radiating assembly 6, which is supported by the gantry structure 5 so as to superiorly and laterally surround the bodywork 2, and is adapted to generate heat in the form of electromagnetic radiations in the infrared band and to radiate such radiations towards the external surface of the bodywork 2 so as to cause the drying of the paint applied on the bodywork 2 itself.

The radiating assembly 6 comprises a plurality of radiating devices 7 mounted on the gantry structure 5 so as to be arranged substantially facing the external upper and side surfaces of the bodywork 2. Each radiating device 7 comprises a box-like containing frame 7*a* (shown in a detail of FIG. 1) made, for example, of stainless steel, and at least one catalytic panel 8 having an substantially rectangular shape and accommodated inside the box-like frame 7*a*. In the particular embodiment shown in FIGS. 1 and 2, each radiating device 7 comprises two catalytic panels 8 accommodated in the box-like structure 7*a* so as to form a larger radiating surface than that of a single catalytic panel 8, so as to adapt to the size and shape of the bodywork 2.

Each catalytic panel 8 is fed by a hydrocarbon gas, such as, for example ethane, propane, butane, or methane, and is adapted to generate energy in the form of electromagnetic waves in the infrared band by means of a catalytic reaction, and specifically a "flameless" catalytic combustion reaction between the hydrocarbon gas and the oxygen present in the air. Furthermore, each radiating device 7 comprises a respective temperature sensor 9 (illustrated in a detail of FIG. 1) of pyrometric type and arranged so as to detect the temperature of the paint applied on a portion of the bodywork 2 facing the radiating device 7 itself and not to be influenced by the heat emanated by the radiating panels 8.

The apparatus 1 further comprises a control unit 10 adapted to adjust the generation of the electromagnetic waves in the infrared band by the radiating devices 7 according to the temperatures detected by the temperature sensors 9.

Figure 3:
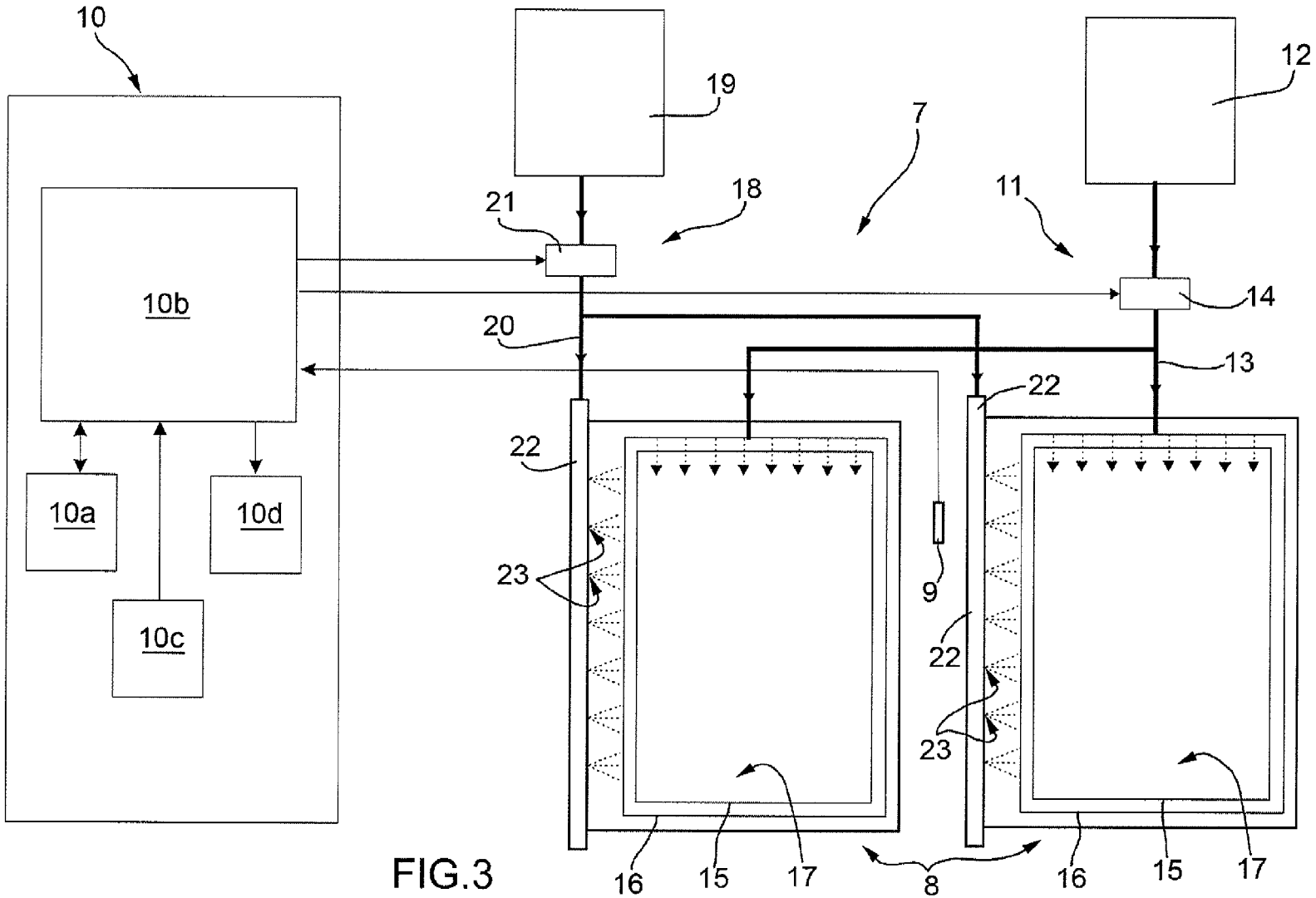
FIG. 3 diagrammatically shows the structure of a radiating device of the apparatus shown in FIG. 1 and the control diagram in which the radiating device is inserted.

With reference to FIG. 3, each radiating device 7 comprises a gas supplying device 11 adapted to take the hydrocarbon gas from a corresponding tank 12 of the apparatus 1 and to feed, upon the control by the control unit 10, the hydrocarbon gas itself to the catalytic panels 8. Specifically, the gas supplying device 11 comprises a distribution circuit 13 for distributing the hydrocarbon gas to the catalytic panels 8 of the corresponding radiating device 7 and at least one solenoid valve 14 controlled by the control unit 10 and arranged in a point of the distribution circuit 13 so as to be able to adjust the flow of hydrocarbon gas fed to such catalytic panels 8, in terms of flow rate and/or pressure.

Each catalytic panel 8 comprises: a catalyzing support or bed 15 of known type preferably made of ceramic material doped with a catalyzing material, e.g. a noble metal consisting of platinum; a preheating resistor (not shown) adapted to take the catalyzing support 16 to a specific temperature so as to activate it before the hydrocarbon gas is fed to the catalytic panel 8; and a porous support 16 connected to the distribution circuit 13 to receive the hydrocarbon gas and arranged facing the catalyzing support 15 to uniformly distribute the hydrocarbon gas on an external, substantially flat surface 17 of the catalyzing support 15 itself. The catalyzing support 15 is structured to be crossed by the hydrocarbon gas in order to be able to break down the molecules of hydrocarbon into atoms of hydrogen and carbon, thus causing a flameless exothermic reaction between the hydrogen, the carbon and the oxygen present in the air on the surface 17, which reaction generates carbon dioxide, aqueous vapor and energy in form of electromagnetic waves in the infrared band. Specifically, the infrared radiations generated by such a catalytic panel 8 are emitted according to a first emission spectrum distributed over a relatively narrow range of wavelengths in the short-wavelength infrared band.

According to the present invention, each radiating device 7 additionally comprises an air supplying device 18 adapted to take a generic mixture of air and oxygen from a specific tank or cylinder 19 of the apparatus 1, to blow the mixture of air and oxygen onto the radiating panels 8 and to adjust the supplying of the mixture of air and oxygen upon the control by the control unit 10. Mixture of air and oxygen hereinafter means a mixture of compressed air and pure oxygen, in which the percentage of compressed air may vary from 0% to 100% and, vice versa, the percentage of pure oxygen may vary from 100% to 0%. In other words, the mixture of air and oxygen may also be formed either by compressed air only, or by pure oxygen only. For simplicity, reference will be made hereinafter to the case of a mixture containing compressed air only, because the use of oxygen does not imply any substantial variation to the apparatus 1, and is however more dangerous than the use of compressed air. Indeed, compressed air provides a high amount of oxygen in any case, but it is not as flammable as pure oxygen.

Specifically, the air supplying device 18 comprises a distribution circuit 20 for distributing the compressed air to the catalytic panels 8 of the corresponding radiating device 7 and at least one solenoid valve 21 controlled by the control unit 10 and arranged in a point of the distribution circuit 13 so as to be able to adjust the flow of compressed air fed to such catalytic panels 8, in terms of flow rate and/or pressure. The air supplying device 18 further comprises at least one supplying pipe 22, and specifically two supplying pipes 22. Each dispensing pipe 22 is mounted to a respective catalytic panel 8, is connected to the distribution circuit 20 downstream of the solenoid valve 21 for receiving the compressed air and has a plurality of openings or holes 23 through which the compressed air is discharged. The holes 23 are reciprocally aligned in positions substantially facing the surface 17 to blow compressed air onto the surface 17 in directions substantially parallel to the surface 17 itself, so as to influence the mentioned catalytic reaction, and specifically to locally boost such a catalytic reaction and cause a variation in the infrared radiation emission spectrum.

Figure 5:
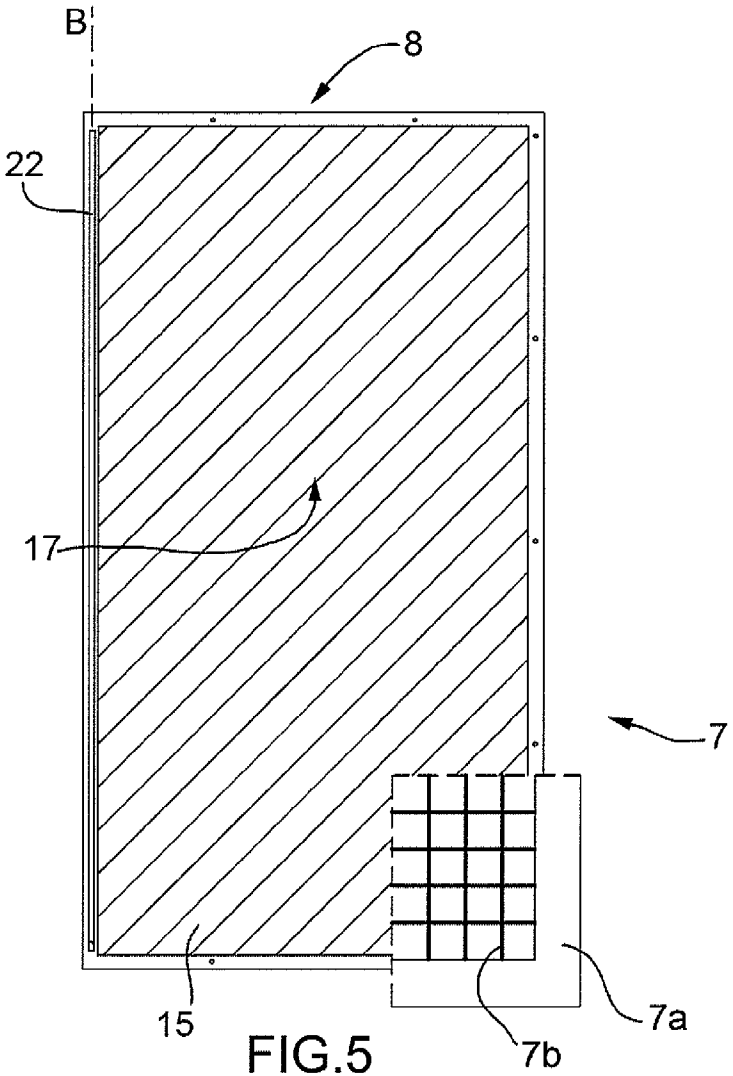
FIGS. 4 and 5 show a perspective and a frontal views, respectively, of a part of the radiating device of the apparatus shown in FIG. 1, with parts of some components removed for clarity.
Figure 4:
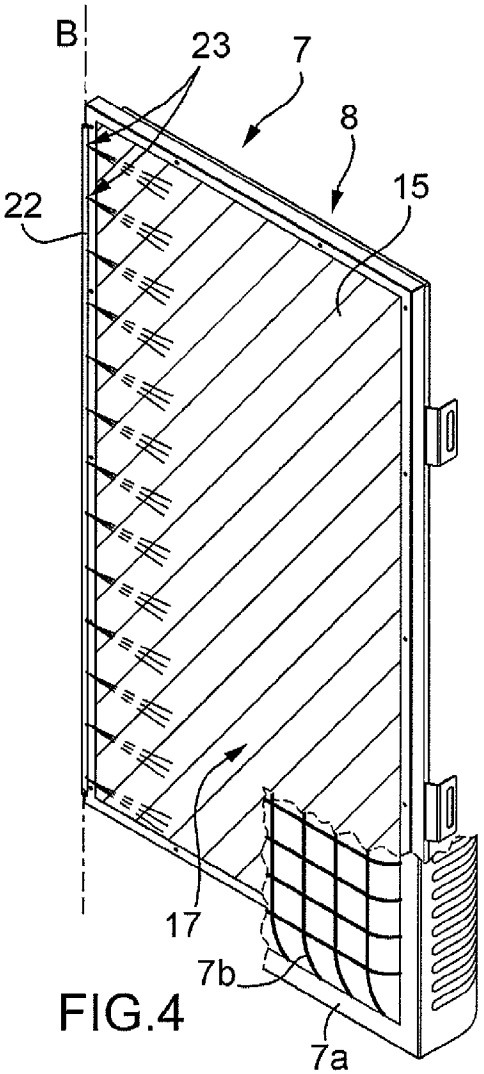

With reference to FIGS. 4 and 5, which show a particular embodiment of the catalytic panel 8 and accessories associated thereto, the catalyzing support 15 and the catalytic panel 8 which incorporates it have a substantially rectangular shape and the supplying pipe 22 extends along an axis B parallel to the longer side edge of the catalyzing support 15. The holes 23 are distributed on the supplying pipe 22 with the respective axes being orthogonal to the axis B and laying on a plane substantially parallel to the surface 17 of the catalyzing support 15. The box-like frame 7*a* has an open side which is protected by a grid 7*b* and which is adapted to face the painted bodywork 2. The catalytic panel 8 is arranged with the surface 17 of the catalyzing support 15 facing said open side.

The supplying pipe 22 and the holes 23 are dimensioned so that the compressed air blown onto the catalytic panel 8 generates, in use, turbulences on the surface 17 such as to distribute the oxygen contained in the blown air in a non-uniform manner on the surface 17 itself. Specifically, the diameter of the holes 23 is in the range of one fifth-one third of the diameter of said supplying pipe 22. The non-uniform distribution of oxygen, combined with the uniform distribution of the hydrocarbon gas, locally boosts the catalytic reaction, in several points of the surface 17, thus creating a non-uniform distribution of the temperature of the surface 17 which causes a variation, and specifically a broadening, of the emission spectrum of the electromagnetic waves generated by the catalytic panel 8. In other words, by blowing the compressed air, a second electromagnetic wave emission spectrum is generated, substantially distributed on the entire short-wavelength infrared band and considerably broader, in terms of wavelength range, than the first emission spectrum, which there would be if no air was blown. More precisely, the second electromagnetic wave emission spectrum is distributed in a wavelength range of 0.7-3.5 μm. Indeed, a high temperature corresponds to a high concentration of oxygen, and thus to an infrared radiation generation having a wavelength close to 0.7 μm, while a relatively low temperature corresponds to a reduced concentration of oxygen, and thus to a generation of infrared radiations having a wavelength close to 3.5 μm.

The second emission spectrum generated in the above-described manner allows to transfer a percentage of radiated energy up to 80% to the paint, regardless of the type of paint or painting product applied onto the bodywork 2, because the emission spectrum distributed in the mentioned wavelength range is compatible with a multiplicity of paint or painting product molecules.

With reference again to FIGS. 1 and 2, the gantry structure 5 comprises a horizontal beam 30 adapted to support the radiating assembly 6. The horizontal beam 30 is arranged to be substantially orthogonal to a vertical middle plane (not shown) of the gantry structure 5, on which middle plane the longitudinal axis A lays, and has a pair of slides 31 at the opposite ends thereof, which slides are slidingly mounted on respective side guides 32, parallel to the longitudinal axis A, and are placed on opposite parts with respect to the middle plane, so as to allow the horizontal beam 30 to translate along the direction D. The two side guides 32 are supported by a series of vertical uprights 33 resting on the base 4 so as to keep the horizontal beam 30 over the bodywork 2.

The radiating assembly 6 comprises at least one pair of side radiating devices 7, which are arranged on opposite sides with respect to the middle plane so as to face the side surfaces of the bodywork 2 and at least one upper radiating device 7, which is arranged in a substantially horizontal position between the side radiating devices 7 so as to face the upper surface of the bodywork 2 in use. In each side radiating device 7, a first of two catalytic panels 8 is in a substantially vertical position, while the second catalytic panel 8 is firmly fixed to the upper end of the first catalytic panel 8 and is inclined with respect to the latter towards the middle plane of the gantry structure 5. In the upper radiating device 7, instead, the two catalytic panels 8 are reciprocally aligned.

The upper radiating device 7 is mounted to the horizontal beam 30 by means of a further pair of slides 34, which are slidingly mounted on respective vertical guides 35 integral with the horizontal beam 30 and placed on opposite sides with respect to the middle plane of the gantry structure 5 to allow the upper radiating device 7 to translate vertically either away from or towards the base 4 so as move either to or away from the upper surface of the bodywork 2, i.e. so as to vary the distance DS between the corresponding catalytic panels 8 and the upper surface of the bodywork 2. Furthermore, the upper radiating device 7 is connected to the slides 34, so as to be able to rotate about an axis C substantially parallel to the base 4, and thus substantially orthogonal to the mentioned middle plane.

The side radiating devices 7 are mounted to the horizontal beam 30 by means of respective arms 36, which are slidingly mounted to a horizontal guide 37 (FIG. 2) obtained in the horizontal beam 30 to allow each side radiating device 7 to translate along a transversal direction with respect to the longitudinal axis A, to and from the middle plane, so as to move either away from or towards a side surface of the bodywork 2, i.e. so as to be able to vary a respective distance DL (FIG. 2) between the corresponding catalytic panels 8 and a side surface of the bodywork 2.

The gantry structure 5 further comprises a plurality of electromechanical actuators (not shown) consisting of electric motors of known type, for example, which are adapted to drive the above-described handling means of the gantry structure 5, upon the control of the control unit 10. Specifically, the electromechanical actuators are adapted to drive the slides 31 and 34 and the arms 36 in order to translate the horizontal beam 30, and thus the entire radiating assembly 6, on the side guides 32 along the direction D, the upper radiating device 7 on the vertical guides 35 to and from the base 4, and the arms 36 along the horizontal guide 35 from and to the middle plane, and to rotate the upper radiating device 7 about the axis C.

With reference to FIG. 3, the control unit 10 comprises a memory **10*a* adapted to store a series of drying recipes in the form of data tables, each of which is univocally associated to a specific paint and comprises an optimal drying temperature of the paint and an optimal interval of exposure time of the paint to the aforesaid second infrared radiation emission spectrum. The control unit 10 further comprises a processing module 10*b* comprising a microprocessor and adapted to control and coordinate the various operative steps of the apparatus 1 operation; preferably, but not necessarily, a control module 10*c*, e.g. a keyboard, adapted to allow a user to select the type of paint applied onto the bodywork 2; and a display 10*d*, e.g. a monitor, adapted to display the various operating steps of the apparatus 1** operation.

The processing module **10*b* is programmed to actuate the electromechanical actuators of the apparatus 1 so as to control, instant by instant, the speed and sense of the displacement, along the direction D, of the horizontal beam 30; the rotation angle of the upper radiating device 7 about the axis C; the speed and sense of the displacement of the upper radiating device 7 in the vertical direction; and the positioning of each arm 36** along the direction transversal to the longitudinal axis A in order to adjust the distance DL.

The processing module **10*b* is further programmed to acquire, by means of the temperature sensors 9, the paint temperature in various portions of the bodywork 2 and to control the solenoid valves 14 and 21 according to the detected temperature so as to adjust, as previously mentioned, the flow rate and/or the pressure of the hydrocarbon gas and compressed air fed to the various radiating devices 7 and, accordingly, to adjust the emission spectrum of the infrared radiations generated by the radiating devices 7**.

In use, after having applied the paint onto the bodywork 2, the user can set, by means of the control module **10*c*, the type of paint which has been applied and needs to be dried, and the processing module 10*b* addresses the memory 10*a*** with the selected type of paint and extracts the corresponding parameters, comprising the optimal drying temperature and the optimal interval of exposure time.

At this point, the control module **10*b* provides for activating the radiating devices 7 for emitting the infrared radiations and for controlling at the same time the electromechanical actuators to move the radiating devices 7 with respect to the bodywork 2** so as to keep the paint at a temperature value substantially equal to the optimal drying temperature.

Specifically, the processing module **10*b* controls the solenoid valve 14 of each radiating device 7 for feeding the hydrocarbon gas to the corresponding catalytic panels 8** so as to activate said catalytic reaction, thus causing the emission of the infrared radiations.

The processing module **10*b* acquires, instant by instant, the paint temperature measured by the temperature sensors 9 and controls the solenoid valve 21 of each radiating device 7 to adjust the flow rate and/or pressure of the compressed air blown onto the corresponding catalytic panels 8** according to the measured temperatures and optimal drying temperature.

Specifically, each solenoid valve 21 is opened/closed (on/off) according to the deviation between the paint temperature measured by the corresponding temperature sensor 9 and the optimal drying temperature. More specifically, if the measured temperature is higher than the optimal temperature by a given margin, the solenoid valve 21 is then closed to cut off the feeding of the compressed air to the corresponding catalytic panels 8 so as to restrict the infrared radiation emission spectrum, and i.e. for generating the mentioned first infrared radiation emission spectrum. Instead, if the measured temperature is lower than the optimal temperature by a given margin, then the solenoid valve 21 is opened to allow the feeding of the compressed air to the corresponding catalytic panels 8 in order to broaden the infrared radiation emission spectrum, and i.e. for generating the mentioned second infrared radiation emission spectrum.

Furthermore, the processing module 10*b* controls the electromechanical actuators for moving the upper radiating device 7 along the guides 35 so as to adjust the distance DS according to the deviation between the temperature measured by the corresponding temperature sensor 9 and the optimal drying temperature and for moving each side radiating device 7 along the guide 37 so as to adjust the corresponding distance DL according to the deviation between the temperature measured by the corresponding temperature sensor 9 and the optimal drying temperature.

Additionally, the processing module 10*b* controls the solenoid valve 14 of each radiating device 7 for adjusting the flow rate and/or the pressure of the hydrocarbon gas fed to the corresponding catalytic panels 8 according to the measured temperatures and to the optimal drying temperature. More in detail, each solenoid valve 14 is closed to interrupt the feeding of hydrocarbon gas to the corresponding catalytic panels 8 according to the deviation between the paint temperature measured by the corresponding temperature sensor 9 and the optimal drying temperature. Such an adjustment is carried out when the paint temperature is too high and the compressed air settings and the distances DS and DL do not allow to reduce the temperature in sufficiently rapid times, i.e. when the deviation between the measured paint temperature and the optimal temperature exceeds a predetermined threshold.

Furthermore, the processing module 10*b* provides for controlling the electromechanical actuators to adjust the forward speed, along the direction D, of the horizontal beam 30, and thus of the entire radiating assembly 6, according to the optimal interval of exposure time and/or according to the deviations between the measured temperatures and the optimal drying temperature. The exposure time of the whole paint applied to the bodywork 2 is thus adjusted at the infrared radiations emitted by the radiating assembly 6. For example, if the measured paint temperature is higher than the optimal drying temperature, the processing module 10*b* may control an increase of the forward speed of the horizontal beam 30, or if the measured paint temperature is lower than the optimal drying value, the processing module 10*b* may control a reduction of the forward speed of the horizontal beam 30.

Finally, the processing module 10*b* controls the rotation of the upper radiating device 7 about the axis C according to the shape of the bodywork 2 and to the forward speed of the horizontal beam 30 according to known techniques.

The above-described apparatus 1 has the advantage of ensuring a drastic reduction of the drying time for the paint with respect to the existing techniques because the emission spectrum of the electromagnetic waves generated by each radiating device 7 is distributed in the wavelength range of 0.7-3.5 μm, and however is compatible with a plurality of painting product molecules, thus allowing to transfer up to 80% of the energy radiated by the radiating device 7 itself to the paint, regardless of the type of paint or painting product used in the touch-up operations of the bodywork 2 of a motor vehicle.

The invention claimed is:

1. An operating method of an apparatus for drying a painting product applied onto an object; the apparatus comprising a radiating assembly comprising at least one catalytic panel, which is fed with hydrocarbon gas for generating infrared radiations according to a first emission spectrum in the short-wave infrared band upon a catalytic reaction between the hydrocarbon gas and the oxygen present in the air and is adapted to emit the infrared radiations towards said object for drying the painting product; the method being characterized in that it comprises the steps of:

blowing, by means of supplying means, a mixture of air and oxygen onto the catalytic panel for influencing said catalytic reactions so as to generate a second infrared radiation emission spectrum broader than that first emission spectrum and distributed in the entire short-wave infrared band;

storing an optimal drying temperature univocally associated to the painting product in an electronic memory;

measuring the temperature of said painting product by means of a temperature sensor associated to said catalytic panel; and adjusting, by means of a first solenoid valve, the feeding of said mixture of air and oxygen to said catalytic panel according to the deviation between the measured temperature of said painting product and said optimal drying temperature.

2. A method according to claim 1, wherein said catalytic panel comprises a catalyzing support having a flat surface on which said catalytic reaction occurs; said mixture of air and oxygen being blown onto said flat surface according to directions which are substantially parallel thereto.

3. A method according to claim 2, comprising the steps of:

uniformly distributing said hydrocarbon gas fed to said catalytic panel on said flat surface of said catalyzing support;

said mixture of air and oxygen being blown so as to generate turbulences on said flat surface, in order to distribute the oxygen contained in the mixture of air and oxygen in a non-uniform manner on the flat surface, so as to accelerate said catalytic reaction in several points of the flat surface and to consequently produce said second infrared radiation emission spectrum.

4. A method according to claim 1, wherein said step of adjusting the feeding of said mixture of air and oxygen to said catalytic panel comprises the steps of:

if the measured temperature of said painting product is higher than said optimal drying temperature, closing said solenoid valve to cut off the feeding of said mixture of air and oxygen to the catalytic panel so as to generate said first infrared radiation emission spectrum; and if the measured temperature of said painting product is lower than said optimal drying temperature, opening said solenoid valve to allow the feeding of said mixture of air and oxygen to the catalytic panel so as to generate said second infrared radiation emission spectrum.

5. A method according to claim 1, wherein said apparatus comprises a base, on which said object is placed, a gantry structure, which rests on the base and comprises supporting means for supporting said catalytic panel, and first handling means mounted to the supporting means to allow the movements of the catalytic panel towards and away from the object; the method comprising the step of:

controlling the first handling means for adjusting a distance (DS, DL) between said catalyzing panel and said object according to the deviation between the measured temperature of said painting product and said optimal drying temperature.

6. A method according to claim 1, wherein said apparatus comprises a drying booth, which extends along a longitudinal axis (A) and is provided with a base on which said object is placed, and a gantry structure, which is arranged inside the drying booth resting on the base and comprises supporting means for supporting said catalytic panel, and second handling means adapted to allow the supporting means to translate with respect to the base parallelly to the longitudinal axis (A); the method comprising the step of:

controlling the second handling means for adjusting the translation speed of the supporting means according to the deviation between the measured temperature of said painting product and said optimal drying temperature in order to adjust the exposure time of said painting product to the infrared radiations.

7. A method according to claim 1, wherein said second infrared radiation emission spectrum is distributed in a wavelength range of 0.7-3.5 μm.

8. A method according to claim 1, wherein the step of blowing a mixture of air and oxygen on the catalytic panel comprises blowing compressed air.

9. A method according to claim 1, wherein said object is constituted by at least one portion of bodywork of a motor vehicle.

* * * * *